US009309889B2

(12) United States Patent
Köck

(10) Patent No.: US 9,309,889 B2
(45) Date of Patent: Apr. 12, 2016

(54) DEVICE FOR DAMPING SLOSHING OF OIL FOR A SCREW-TYPE COMPRESSOR

(75) Inventor: Engelbert Köck, Planegg (DE)

(73) Assignee: KNORR-BREMSE SYSTEME FUR SCHIENENFAHRZEUGE GMBH, Munich (DE)

( * ) Notice: Subject to any disclaimer, the term of this patent is extended or adjusted under 35 U.S.C. 154(b) by 126 days.

(21) Appl. No.: 13/641,248

(22) PCT Filed: Apr. 13, 2011

(86) PCT No.: PCT/EP2011/055784

§ 371 (c)(1),
(2), (4) Date: Dec. 3, 2012

(87) PCT Pub. No.: WO2011/128362

PCT Pub. Date: Oct. 20, 2011

(65) Prior Publication Data

US 2013/0108497 A1 May 2, 2013

(30) Foreign Application Priority Data

Apr. 16, 2010 (DE) ..... 10 2010 015 147

(51) Int. Cl.
*F01C 21/04* (2006.01)
*F03C 2/00* (2006.01)
(Continued)

(52) U.S. Cl.
CPC ..... *F04C 29/028* (2013.01); *F04C 2/102* (2013.01); *F04C 29/02* (2013.01); *F04C 29/026* (2013.01); *F04C 29/12* (2013.01); *F04C 18/16* (2013.01); *F04C 2240/809* (2013.01)

(58) Field of Classification Search
CPC ..... F04C 18/16; F04C 2/086; F04C 2/102; F04C 29/0092; F04C 29/02; F04C 29/026; F04C 29/028; F04C 29/12; F04C 29/128; F04C 2240/809
USPC ..... 418/46–47, 83, 89–90, 201.1, 270, 418/DIG. 1
See application file for complete search history.

(56) References Cited

U.S. PATENT DOCUMENTS 4,004,933 A * 1/1977 Ravault ..... 501/81
4,627,406 A * 12/1986 Namiki et al. ..... 55/446
(Continued)

FOREIGN PATENT DOCUMENTS

CN 101220814 A 7/2008
DE 10254572 A1 3/2004
(Continued)

OTHER PUBLICATIONS

Search Report for International Patent Application No. PCT/EP2011/055784; Jun. 1, 2012.
(Continued)

*Primary Examiner* — Theresa Trieu
(74) *Attorney, Agent, or Firm* — Barnes & Thornburg LLP

(57) ABSTRACT

A screw-type compressor, in particular for use in a vehicle, wherein the screw-type compressor has an oil sump with a device for damping sloshing of oil. A screw-type compressor is made available in which the device for damping sloshing of oil is improved compared to the prior art. The device for damping sloshing of oil is a barrier device which prevents the oil from rising up a housing wall of the screw-type compressor.

5 Claims, 3 Drawing Sheets

(51) Int. Cl.

| | |
|---|---|
| ***F03C 4/00*** | (2006.01) |
| ***F04C 2/00*** | (2006.01) |
| ***F04C 29/02*** | (2006.01) |
| ***F04C 2/10*** | (2006.01) |
| ***F04C 29/12*** | (2006.01) |
| *F04C 18/16* | (2006.01) |

(56) References Cited

U.S. PATENT DOCUMENTS

| | | | | |
|---|---|---|---|---|
| 5,494,412 | A | 2/1996 | Shin | |
| 5,753,013 | A * | 5/1998 | Dingfelder | 55/442 |
| 6,143,169 | A | 11/2000 | Lee | |
| 6,237,362 | B1 | 5/2001 | Jang | |
| 6,705,270 | B1 | 3/2004 | Rau et al. | |
| 7,600,982 | B2 | 10/2009 | Koeck | |
| 8,028,672 | B2 | 10/2011 | Prior et al. | |

FOREIGN PATENT DOCUMENTS

| | | | |
|---|---|---|---|
| DE | 102004060417 | A1 | 7/2006 |
| DE | 10 2008 019 676 | A1 | 10/2009 |
| DE | 10 2009 010 282 | A1 | 1/2010 |
| DE | 10 2008 060 411 | A1 | 6/2010 |
| JP | 58-175194 | U | 11/1983 |
| JP | 3026879 | A | 2/1991 |
| JP | 7224762 | A | 8/1995 |
| JP | 2000-234826 | A | 8/2000 |
| JP | 2004176701 | A | 6/2004 |
| WO | 0118461 | A1 | 3/2001 |
| WO | 01/83954 | | 11/2001 |
| WO | 2005080797 | A1 | 9/2005 |

OTHER PUBLICATIONS

Notification Concerning Transmittal of International Preliminary Report on Patentability and Written Opinion of the International Search Authority for International Patent Application No. PCT/EP2011/055784, dated Apr. 13, 2011.

English Translation of Notification Concerning Transmittal of International Preliminary Report on Patentability and Written Opinion of the International Search Authority for International Patent Application No. PCT/EP2011/055784, dated Apr. 13, 2011.

Chinese Office Action for Patent Application No. 201180019505.7 dated Sep. 24, 2014.

Japanese Office Action with English Translation for Japanese Patent Application No. 2013-504255 dated Apr. 6, 2015.

* cited by examiner

DEVICE FOR DAMPING SLOSHING OF OIL FOR A SCREW-TYPE COMPRESSOR

PRIORITY CLAIM

This patent application is a U.S. National Phase of International Patent Application No. PCT/EP2011/055784, filed 13 Apr. 2011, which claims priority to German Patent Application No. 10 2010 015 147.5, filed 16 Apr. 2010, the disclosures of which are incorporated herein by reference in their entirety.

FIELD

Disclosed embodiments relate to a screw-type compressor, particularly for use in a vehicle, the screw-type compressor having an oil sump with a device for damping the sloshing of oil.

BACKGROUND

A screw-type compressor of this type is known from DE 10 2004 060 417 A1. This screw-type compressor is designed for mobile use in a vehicle, which is the subject of the disclosed embodiments being concerned with making the rotational speed of the engine unit assigned solely to the screw-type compressor, adjustable in accordance with a control unit, in such a way that the screw-type compressor generates a stipulated compressed air delivery capacity independently of the vehicle engine. The screw-type compressor is designed in structural terms such that a first housing part as a multipart housing has an oil sump with an oil sloshing damping device, the oil sloshing damping device not being defined in any more detail.

An oil sloshing damping device is known, furthermore, from DE 102 54 572 A1. This oil sloshing damping device is installed in a gearshift transmission housing for a vehicle and is designed in the form of ribs which are arranged in the bottom region of the transmission housing.

SUMMARY

Disclosed embodiments provide a screw-type compressor in which the oil sloshing damping device is improved, as compared with the prior art, by providing a screw-type compressor in which the oil sloshing damping device is improved, as compared with the prior art.

BRIEF DESCRIPTION OF THE FIGURES

Details of advantageous refinements of the disclosed embodiments may be gathered from the drawing description which describes in more detail exemplary embodiments, illustrated in the figures.

DETAILED DESCRIPTION

Disclosed embodiments provide a screw-type compressor in which the oil sloshing damping device is improved, as compared with the prior art, This is achieved in that the oil sloshing damping device is a barrier device preventing oil from running up on a housing wall of the screw-type compressor. To be precise, for example, the use only of ribs arranged in the oil sump is not sufficient for effective oil sloshing damping and cannot prevent the situation where the oil may run up on the housing walls. This effect occurs particularly in screw-type compressors which are used in vehicles, such as road vehicles and/or rail vehicles, and in which oil sloshing arises due to pronounced accelerations and vibrations. Such oil sloshing means that there is no certainty of reliable oil separation in a final separation stage, since the final separation stage of the oil separation device is overloaded on account of the direct ingress of oil.

Accordingly, disclosed embodiments provide a barrier device that is configured of single-stage or multistage design. Particularly in the case of the barrier device as a multistage design, oil sloshing is reliably prevented.

In a further refinement of the disclosed embodiments, the barrier device is at least one fitting inserted vertically into the oil sump optionally above an oil level. In an optional further refinement, this fitting is in turn a perforated plate. Such a perforated plate is available or can be produced simply in various variants. In this case, on the one hand, such a perforated plate ensures that oil flowing out of the separator 6 of the screw-type compressor passes, virtually unimpeded, into the oil sump and, on the other hand, even in the event of pronounced accelerations or vibrations, prevents oil from passing through the perforated plate, running up on the housing wall and returning to the separator 6.

Figure 3:
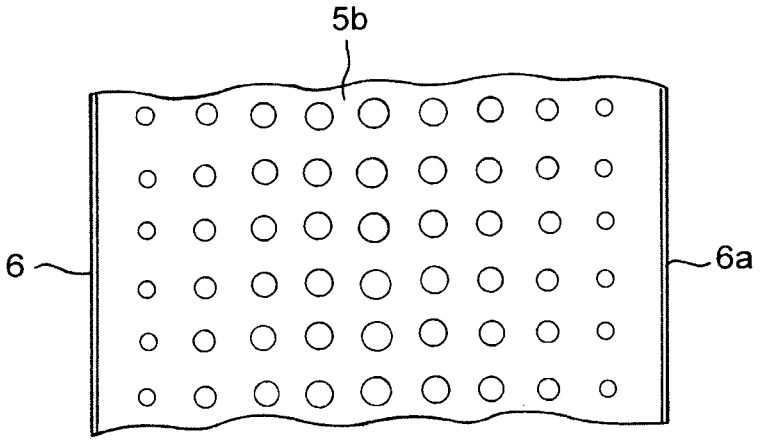
FIG. 3 shows the diameter of holes in the perforated sheet

This is achieved especially effectively if two perforated plates are inserted, offset to one another and one above the other, into the housing forming the oil sump. What is achieved thereby is that oil or oil drops which have passed through an orifice in the lower perforated plate and have broken away are captured by the second perforated plate, adhere to this and are conducted back into the oil sump again as a result of gravity. The size of the holes in the perforated plate must be dimensioned such that the oil to be introduced overall in the oil sump flows through a multiplicity of holes, that is to say the volume flow to be introduced into the oil sump is divided into a plurality of small volume flows. The holes can be designed to be correspondingly small and oil sloshing can be prevented. There may also be provision for configuring the diameter of the holes differently, for example, as seen in in FIG. 3 the diameter of the holes in the perforated plate 5*b* may be smaller in the region of the housing walls 6, 6a than in the middle of the oil sump. Such a refinement assists in preventing oil from running up in the region of the housing walls. In this case, of course, care must be taken to ensure that the execution of the holes or of the perforated plates is such that the necessary circulation of oil within the apparatus is not impaired or not excessively impaired.

In an alternative refinement, the fitting may be designed as an oil-permeable three-dimensional structure. Such a structure is, for example, a porous body which can be produced, for example, from ceramic foam. However, such a structure may also be composed, for example, of a plurality of plate elements arranged in different directions.

Figure 1:
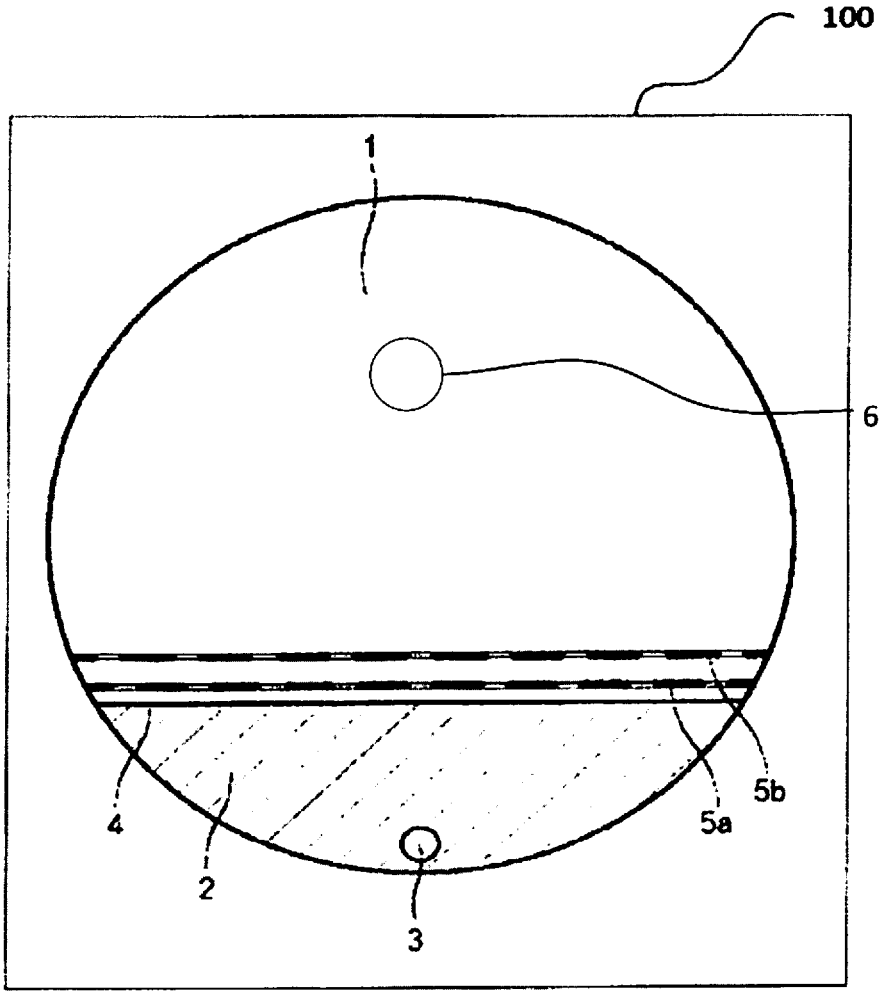
FIG. 1 shows a section through a diagrammatically illustrated screw-type compressor.

As shown in FIG. 1, a screw-type compressor 100 has a pressure vessel in which oil is collected so as to form an oil sump 1. Such a screw-type compressor is provided, for example, in road vehicles and/or rail vehicles for generating compressed air which is required inter alia for the supply of compressed air brake systems. Oil is conveyed continually through such a screw-type compressor for lubricating and cooling and for sealing off, in particular, the moved components. The oil level in the pressure vessel may vary sharply according to the operating conditions. Thus, during idling or at a standstill, the oil level reaches a relatively high value above a minimum level, while, in the event of a subsequent changeover to operating under load, the oil level may fall to or, as is to be avoided, below a minimum level because conveyance through the screw-type compressor is then switched on. Such fluctuations particularly toward the undershooting of a minimum level are intensified by leakage or natural consumption. Furthermore, the use of the machine or vehicle, for example when it is operating in an inclined position, also has an effect upon the oil level of the installed screw-type compressor. In addition, on account of accelerations and/or vibrations, the oil also sloshes back and forth in the oil pan. As a result, on the one hand, reliable oil level measurement is scarcely possible and, on the other hand, oil separation in a final separation stage becomes difficult.

As shown in FIG. 1, the oil supplied by the first separation collects in the bottom region of an oil sump 2 and is fed again through a suction extraction orifice 3 to the lubricating and cooling circuit of the screw-type compressor.

Figure 2:
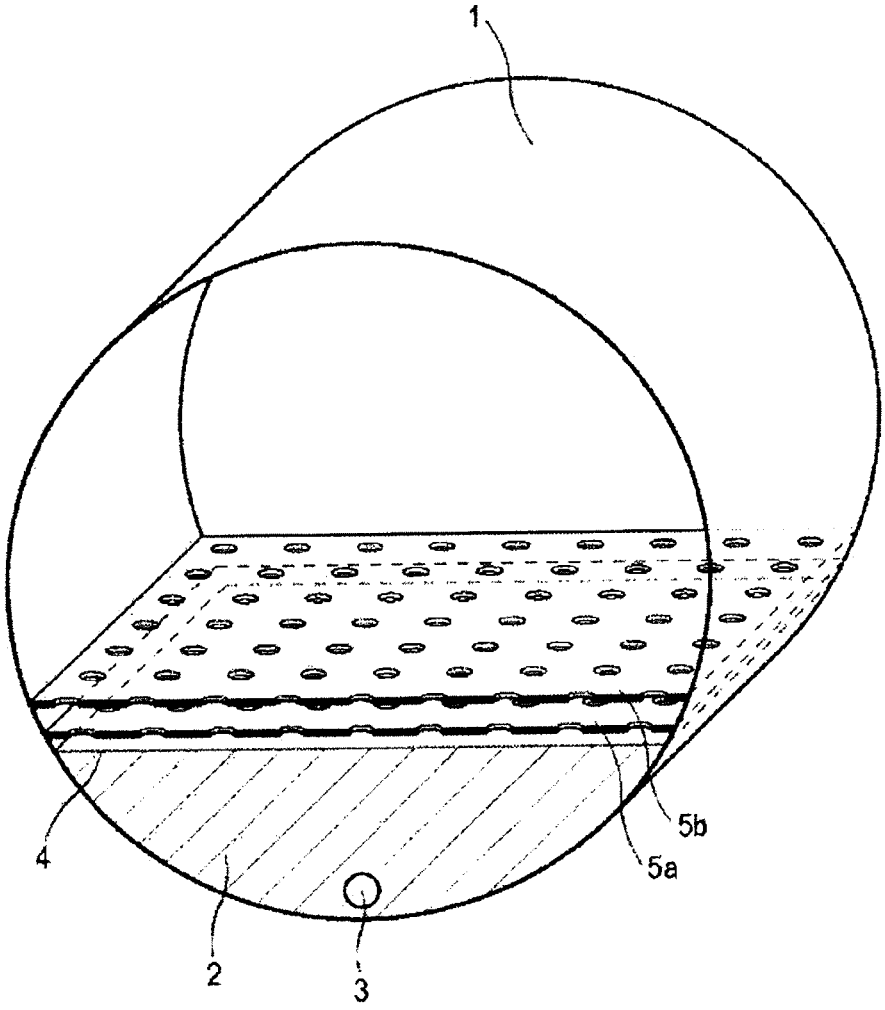
FIG. 2 shows a perspective view of FIG. 1.

A first perforated plate 5*a* is arranged above the oil level 4 and a second perforated plate 5*b* is fastened at a short distance above the first perforated plate 5*a*. As will be gathered from the perspective view according to FIG. 2, the perforated plates 5*a*, 5*b* are arranged so as to be offset to one another such that, due to pronounced acceleration and/or vibration, an oil gush or an oil drop passing out of the oil sump 2 through an orifice or hole in the first perforated plate 5*a* and breaking away impinges onto the wall of the second perforated plate 5*b*.

The perforated plates 5*a*, 5*b* may be manufactured from a metallic or nonmetallic material, such as, for example, sheet metal, aluminum or heat-resistant plastic, and may be fastened in the oil sump 1, for example, by welding, soldering, adhesive bonding or positive connections.

LIST OF REFERENCE SYMBOLS

1 Oil sump
2 Oil
3 Suction extraction orifice
4 Oil level
5*a*, 5*b* Perforated plate
6, 6*a* Region of the housing walls
100 Screw-type compressor
6. Separator orifice

The invention claimed is:

1. An oil sump for a screw-type compressor comprising:

a multistage design device for damping sloshing of oil, wherein the oil sloshing damping device is a barrier device preventing oil from running up a housing wall of a housing of the oil sump above the barrier, wherein the multistage design device comprises two perforated plates lying in parallel planes perpendicular to the force of gravity acting on the oil included in the oil sump, and wherein the perforations of each plate are offset to one another in the housing of the oil sump so that oil flowing out of a separator of the screw-type compressor passes through the two perforated plates in the oil sump and oil in the sump is prevented from running up on the housing wall and returning to the separator.

2. The oil sump of claim 1, wherein the two perforated plates are above an oil level in the oil sump.

3. The oil sump of claim 1, further comprising a suction orifice, wherein the suction orifice lies in a plane of the housing parallel to the two perforated plates.

4. The oil sump of claim 1, wherein the two perforated plates lie spaced apart relative to each other in the direction of gravity.

5. An oil sump for a screw-type compressor comprising:

a multistage design device for damping sloshing of oil, wherein the oil sloshing damping device is a barrier device preventing oil from running up a housing wall of a housing of the oil sump above the barrier, wherein the multistage design device comprises two perforated plates lying in parallel planes perpendicular to the force of gravity acting on the oil included in the oil sump, and wherein the perforations of each plate are offset to one another in the housing of the oil sump, wherein the two perforated plates comprise holes of varying diameter, wherein the diameters of the holes are smaller in regions closer to the housing wall than in the middle of the oil sump.

* * * * *